US005867959A

United States Patent [19]

Ruble et al.

[11] Patent Number: 5,867,959

[45] Date of Patent: Feb. 9, 1999

[54] CLIP CONNECTOR

[75] Inventors: Ray C. Ruble, Loveland; Robert Caudill, Miamisburg, both of Ohio

[73] Assignee: Steelox System, Inc., Mason, Ohio

[21] Appl. No.: 880,108

[22] Filed: Jun. 20, 1997

[51] Int. Cl.[6] ..... E04D 1/34

[52] U.S. Cl. ..... 52/545; 52/544; 52/520

[58] Field of Search ..... 52/520, 543, 544, 52/545, 546, 547, 573.1, 478, 767, 489.1, 542, 713, 528

[56] References Cited

U.S. PATENT DOCUMENTS

| | | | |
|---|---|---|---|
| 1,273,500 | 7/1918 | Kettelson . | |
| 2,057,819 | 10/1936 | Corcoran et al. | 108/10 |
| 2,558,720 | 7/1951 | Hansman | 85/36 |
| 3,590,543 | 7/1971 | Heirich | 52/478 |
| 4,034,532 | 7/1977 | Reinwall, Jr. | 52/520 |
| 4,435,937 | 3/1984 | Stone | 52/520 |
| 4,522,005 | 6/1985 | Seaburg et al. | 52/544 |
| 4,728,235 | 3/1988 | Patti | 411/174 |
| 4,865,881 | 9/1989 | Sessa et al. | 427/181 |
| 4,972,647 | 11/1990 | Meldrum | 52/513 |

*Primary Examiner*—Creighton Smith
*Attorney, Agent, or Firm*—Thompson Hine & Flory LLP

[57] ABSTRACT

A clip connector having a base and a clip, the base including a washer/spacer to prevent the base from clamping upon the clip to allow free movement of the clip in the base. The washer has a bore having a flared portion to collect shavings generated by a self-drilling screw. The clip connector includes a clip, or use with a roof, having a series of regularly spaced holes to allow sealant to pass therethrough. The clip further preferably has a rounded head which nests snugly with associated panels and includes a fastener extending through the foot of the clip to retain the foot in the desired position. In this manner, the overlapping portions of the foot remain pressed together, thereby facilitating the sliding of the clip within the base. The clip preferably includes a shelf to support panels during connection of the panels to the clip of the present invention.

13 Claims, 6 Drawing Sheets

CLIP CONNECTOR

BACKGROUND

The present invention relates to methods and devices for joining building structures, and more particularly, to methods and devices for joining building panels such as roofing, wall and flooring panels to frame members.

Metal building structures, such as roof, floor and wall structures typically include a plurality of spaced supporting members, such as purlins, joists or girts, to buttress the structures. A series of relatively rigid interlocked roof or wall panels is placed upon the supporting members and traverses the gaps between the members. Typically, the panels are lapped and sealed, depending upon the length of the roof or wall and the panel length. A clip connector is utilized to couple the panels to the supporting members. The connector comprises a clip and a generally U-shaped base slidably mounted to the clip. The base has a generally horizontal channel extending therethrough, and the clip is movable in the channel. When the panels are coupled to the clip, the roof or wall structure is movable with respect to the supporting members. Such a connector having a clip and a base is shown in U.S. Pat. No. 4,522,005 to Seaberg et al.

However, there are several drawbacks with such a clip connector design. For example, when attaching a clip connector to an underlying supporting member, a fastener, such as a self-drilling screw, is passed through the base of the connector and into the supporting member. However, the fastener may be overtightened such that the base clamps against the clip retained in the channel, which prevents the clip from freely sliding in the base. Furthermore, when a self-drilling screw is utilized as the fastener, shavings generated by the screw may build up around the shank of the screw beneath the base which prevents the base from being seated properly on the supporting member.

The clips of such prior art connectors also may have disadvantaged. For example, holes typically are positioned along the top of the clips which allow sealant to be distributed between overlapping panels to form a seal between the panels and the clip. However, hole patterns in existing clips do not always provide for effective, continuous distribution of the sealant which can lead to a faulty seal. Furthermore, the profile of the top of the clips optimally should provide for a snug fit between the overlapping panels and the clip. However, existing clip designs do not provide an integral fit with several panel designs.

Further drawbacks in existing clips exist in the foot design of the clip, which may not always properly retain its shape. This can inhibit effective sliding of the clip within the associated base. Finally, prior art clips do not provide a support surface on which the panels may be rested during attachment of the panels to the clip. This causes inconvenience to the worker when attaching the panels.

SUMMARY OF THE INVENTION

The present invention is a clip connector of a type having a base and clip which are shaped to overcome the disadvantage of prior art devices. In a preferred embodiment, the base includes a washer/spacer which prevents the base from clamping a clip retained therein to allow free movement of the clip in the base. The washer includes a bore having a downwardly-opening, flared portion to collect shavings generated by a self-drilling screw. The present invention includes a clip, for use with a roof connector, having a series of regularly spaced holes to allow sealant to pass therethrough.

In addition, the clip has a rounded head which nests snugly between the associated panels and includes a fastener passed through the foot of the clip to retain the foot in the desired position. In this manner, the overlapping portions of the foot remain pressed together, thereby facilitating the sliding of the clip within the base. The clip also includes a shelf which supports panels during the process o connecting the panels to the clip of the present invention.

Also in a preferred embodiment, a clip includes an upstanding planar body, a crown which mates with the interlocked panels, and a foot formed from the bottom of the planar body and being substantially perpendicular thereto and extending outwardly therefrom to form toe and heel portions, respectively. The clip further includes a generally U-shaped base slidably engaged on the foot and projecting outwardly therefrom, the base having an upwardly-opening mouth to receive the planar body, a cover overlying the toe and a sole associated with the heel and underlying the foot, an aperture extending through the cover and the sole exteriorly of the base, and a washer located between the cover and the sole and axially aligned with the aperture, whereby a fastener may be extended through the aperture and the washer for securing the base to a supporting member, the fastener forcing the cover and sole into retained but slidable engagement with the foot, the washer preventing overtightening of the fastener to thereby avoid clamping of the cover and sole on the foot such that the panels are movable with respect to the supporting members as the foot moves with respect to the base.

Accordingly, it is an object of the present invention to provide for a base for a roofing clip connector which can avoid clamping an associated clip, base which provides a receptacle to collect shavings generated by a self-drilling screw during attachment of the clip; a roofing connector having a clip with a series of spaced apertures to distribute the flow of sealants effectively; a clip having a profile shaped to fit snugly with associated panels; a clip having a foot which effectively retains its shape to facilitate sliding of the clip along an associated base; and a clip having a support surface to facilitate worker connection of the panels to the clip.

These and other objects and advantages of the present invention will be more fully understood and appreciated by reference to the following description, the accompanying drawings and the appended claims.

DETAILED DESCRIPTION

Figure 1:
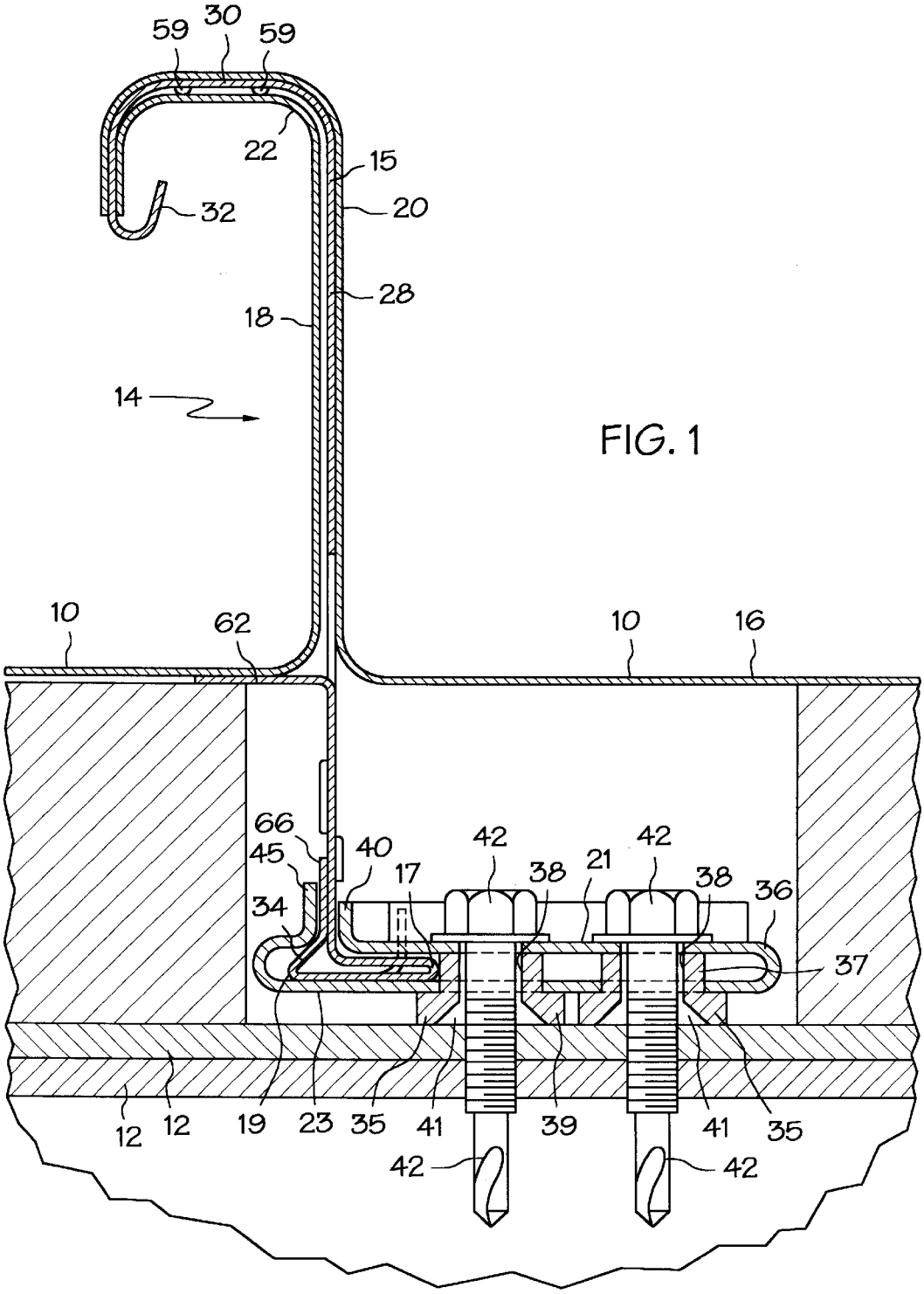
FIG. 1 is a side elevational view of a preferred embodiment of the clip connector of the present invention, shown in a roofing system.
Figure 2:
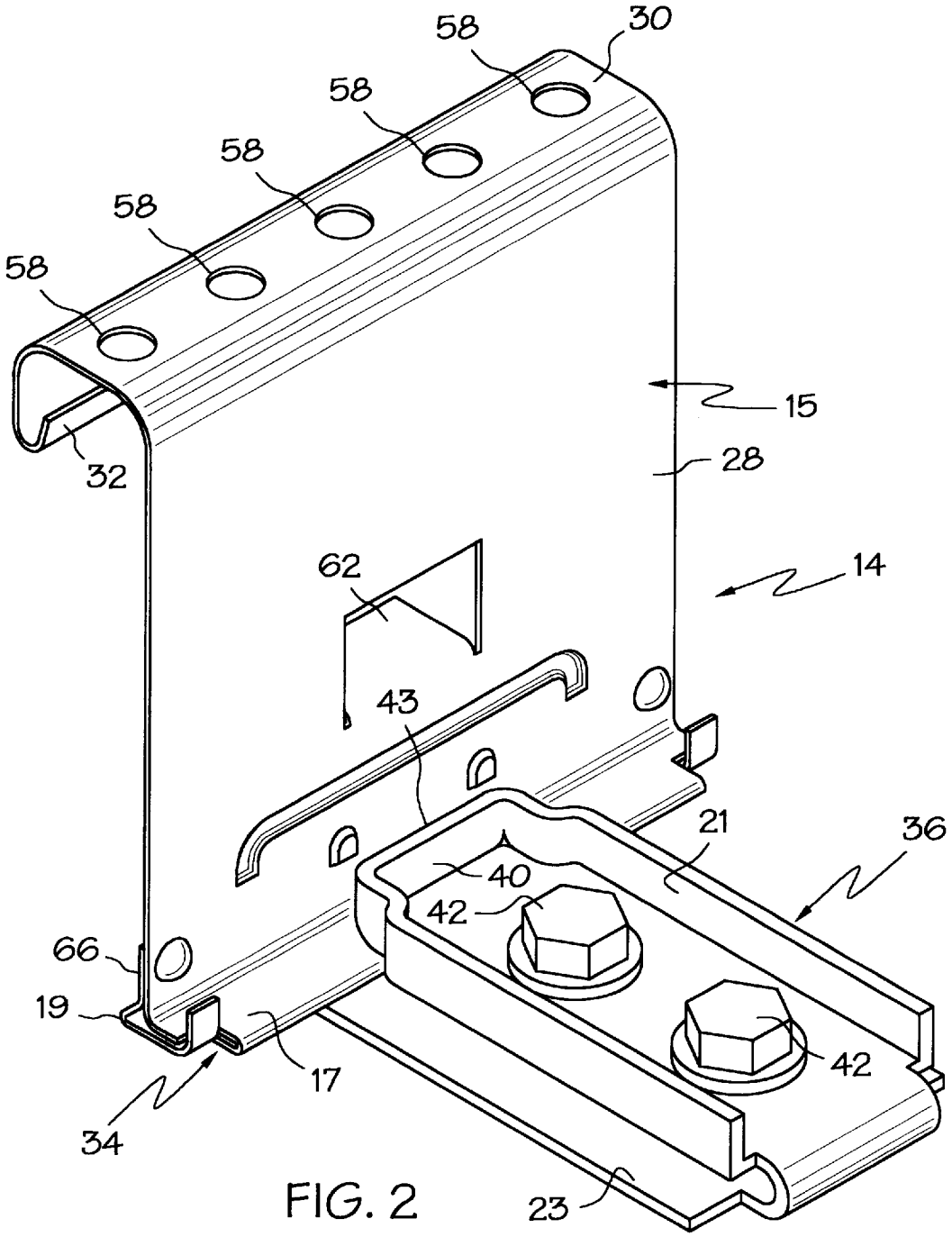
FIG. 2 is a perspective view of a base and clip of the connector of FIG. 1.
Figure 3:
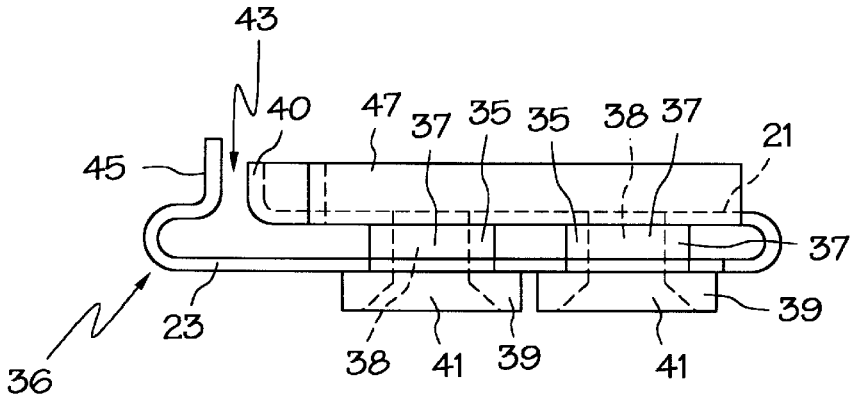
FIG. 3 is a side elevational view of the connector of FIG. 2.
Figure 4:
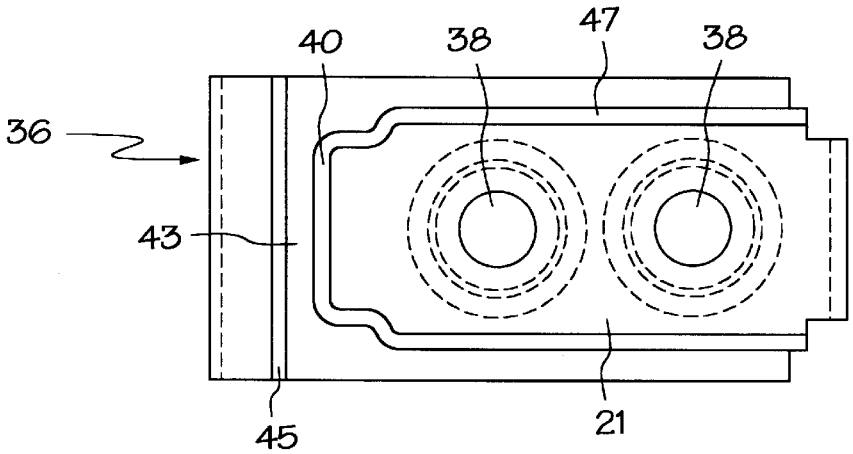
FIG. 4 is a top plan view of the base of FIG. 3.
Figure 5:
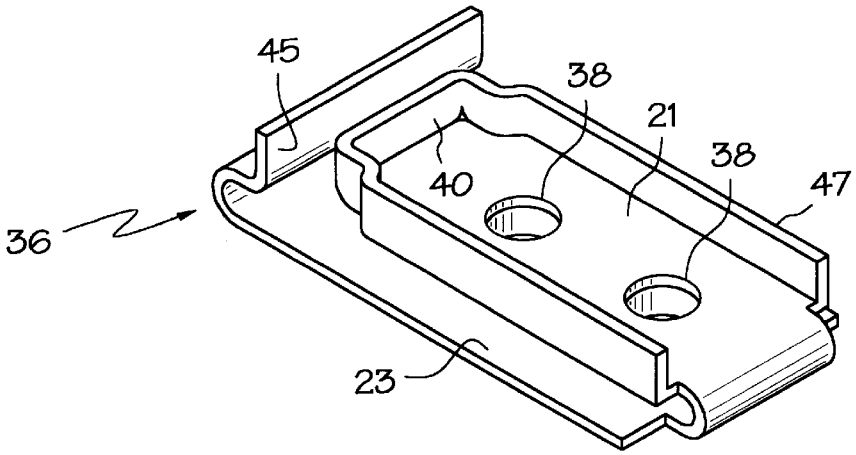
FIG. 5 is a perspective view of the clip of the base of FIG. 3.
Figure 7:
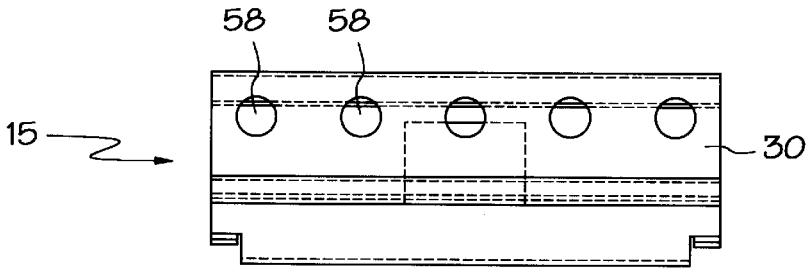
FIG. 7 is a top plan view of the clip of FIG. 6.

While the clip connector of the present invention will be described in terms of its use for the interconnection of roof panels in securement of roof panels to a supporting structure, it is to be understood that this description is exemplary only and that the clip connector of the present invention may be used for connecting a variety of covering members to framing members, including connecting roofing, wall and floor panels to supporting members such as purlins, joists or girts. As shown in FIG. 1, the clip 14 of the present invention is used in conjunction series of relatively stiff, rigid interlocked panels 10. The panels 10 are affixed to, and bridge the spaces between, the spaced supporting members 12. The clip connectors 14 are of a relatively shorter length than the coupled panels 10, and anchor the coupled panels 10 to the purlins 12. Each of the panels 10 is provided with a central web surface 16 and a pair of side walls forming male and female members 18 and 20, respectively, projecting outwardly from opposing edges of the web 16. The male member 18 and female member 20 are adapted to interlock to form rib joints 22. As shown in FIGS. 1 and 2, the clip connector 14 of the present invention includes a clip 15 having an upstanding planar body 28, a crown 30, which mates with a rib joint 22 of interlocking panels 10, and a foot 34 formed from the upstanding planar body 28 and oriented substantially perpendicular thereto and extending therefrom to form toe and heel portions 17 and 19, respectively. Bottom portion 66 is located adjacent to the foot 34, and is formed by folding the upstanding planar body 28 upon itself.

A base 36 slidably engages the foot 34 and projects outwardly therefrom. As shown in FIGS. 1–5, the base 36 is generally U-shaped in profile and has an upwardly-opening mouth 43. The base 36 includes a cover 21 overlying the toe 17 of the foot 34 (see FIGS. 1 and 2) and a sole 23 associated with the heel 19 of the foot 34 and underlying the foot 34. A pair of apertures 38 extend through the cover 21 and the sole 23, exteriorly of the foot 34. A pair of washer/spacer elements 35 are axially aligned with each aperture 38. Each washer/spacer element 35 preferably includes an upper section 37 located between the cover 21 and the sole 23, and a lower section 39 located below the sole 23. The lower section 39 of the washer/spacer element 35 includes a flared bore 41. The bore 41 is outwardly flared; that is, the bore radius increases outwardly from the axial center of the washer/spacer 35.

As shown in FIG. 1, a suitable through fasteners, such as self-drilling screws 42, extend through apertures 38, thereby securing the base 36 to the supporting member 12. This forces the cover 21 and sole 23 of the base 36 into restrained but slidable engagement with the foot 34, and the foot is free to movement entire length thereof. The upper section 37 of the washer/spacer element 35 is located so as to prevent overtightening of the fasteners 42 that might cause the cover 21 and sole 23 to converge such that they clamp upon the foot 34 and thereby prevent free movement of the foot 34 within the base 36. Each flared bore 41 included in the lower section 39 of the washer/spacer 35 is shaped to collect shavings when the through fastener 42 is attached to a supporting member, such as the purlin 12. In this manner, the flared bore 41 accumulates shavings (not shown) which allows the base to seat properly on the framing member 12.

The crown 30 of the upstanding planar body 28 is shaped to receive the male portion 18 and female portion 20 of the panels 10 utilized in conjunction with the present invention (see FIG. 1). Crown 30 has curved corners and a curved hook portion 32 to mate with the panel members 10. The curved profile of the crown 30 provides for a tighter fit and less shifting of the panels 10 relative to the clip 14. The crown 30 may have different shapes to mate with a variety of prior art interlocking panels 10.

The ends of the cover 21 and sole 23 which are contiguous with the upstanding planar element 28, and are preferably provided with upstanding stiffening flanges 40 and 45, respectively. The upstanding stiffening flanges 40 and 45 form an upwardly-opening mouth 43 to receive the upstanding planar body 28. Additionally, an upstanding flange 47, which may be a separate piece or integral with the upstanding flange 37, may be provided on the top of the cover 21. The flanges 40, 45 and 47 assist in preventing the foot 34 from pulling out of the base 36, and in precluding the base 36 from bending and unraveling during panel movements caused by thermal gradients or wind or snow loads.

Figure 6:
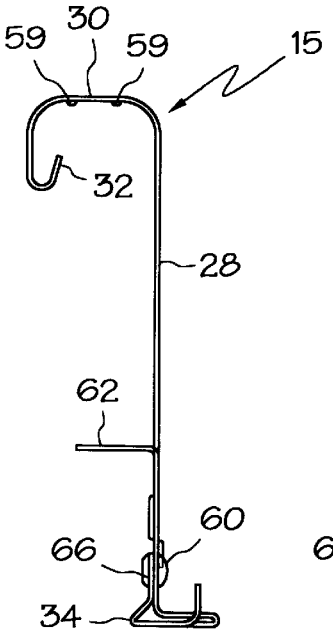
FIG. 6 is a side elevational view of the clip of FIG. 2.
Figure 8:
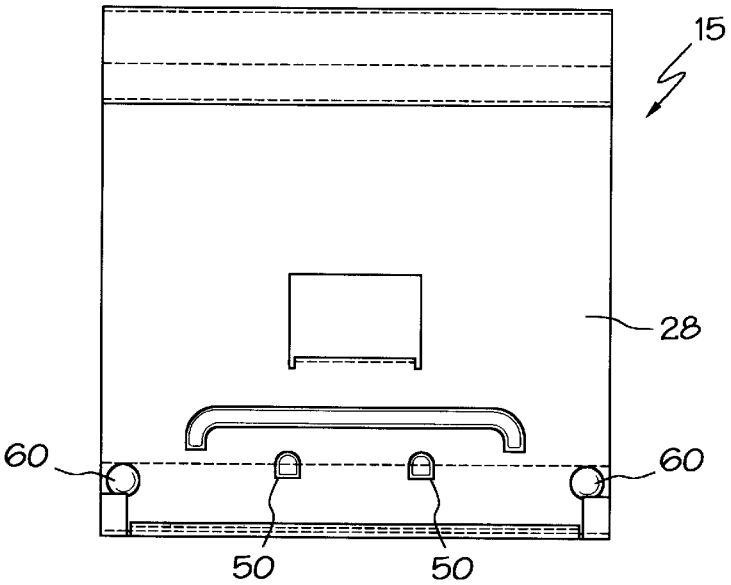
FIG. 8 is an end elevational view of the clips of FIG. 5.
Figure 9:
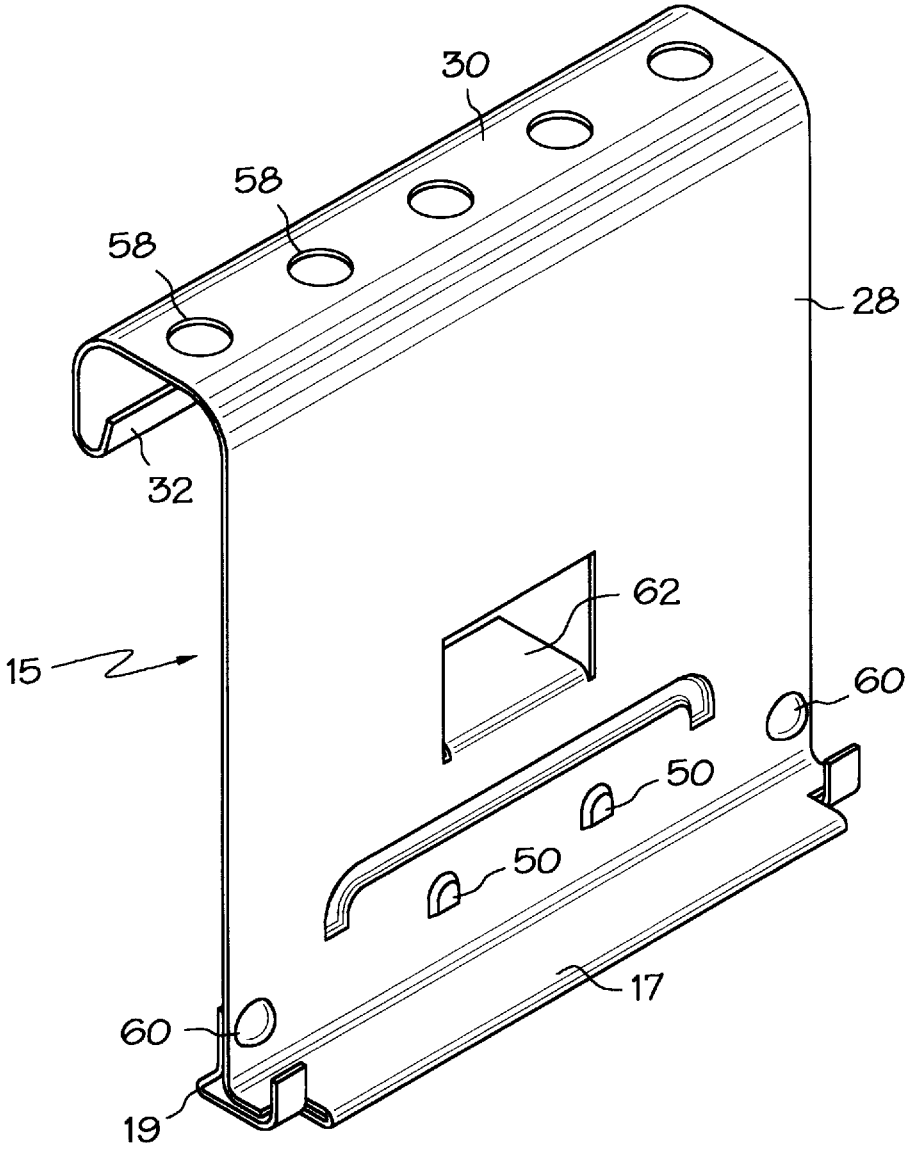
FIG. 9 is a perspective view of the clip of FIG. 5.
Figure 10:
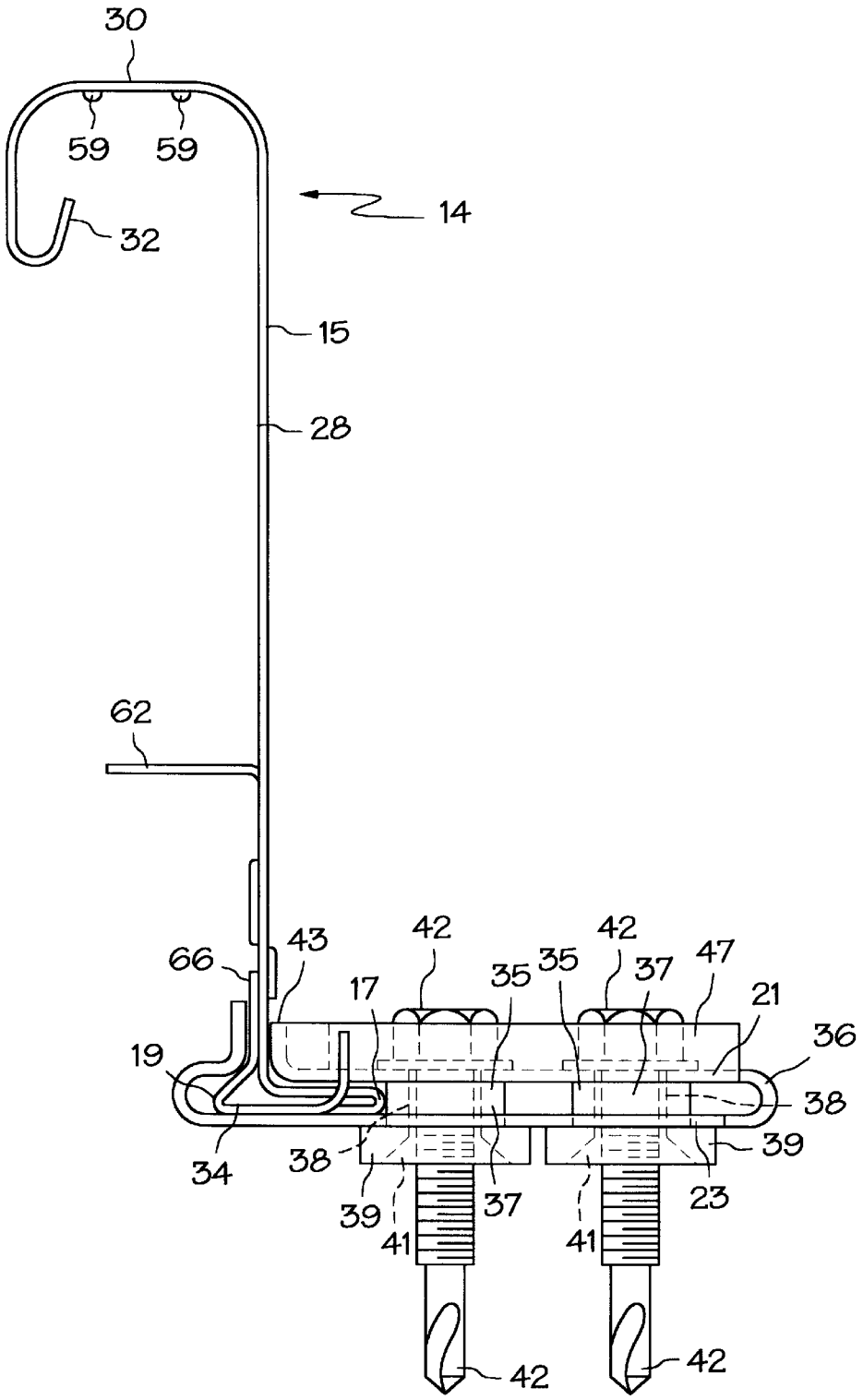
FIG. 10 is a side elevational view of a preferred embodiment of the clip connector of the present invention.

The clip connector 14 of the present invention may be provided with spaced apertures 58 spaced along the crown 30 to facilitate the flow of the sealant (not shown). Sealant may take the form of a bead of sealant located on the underside of the female member 20, or a corresponding bead of sealant located on the underside of crown 30. The apertures 58 are evenly longitudinally spaced across the crown 30. Besides the apertures 58 on the crown 30, the crown 30 includes a double row of dimples 59 extending widthwise across the underside of the crown (see FIGS. 1, 6 and 10). The dimples provide a gap between the crown 30 and side wall male member 18 (see FIG. 1) to receive sealant (not shown).

Rivets 60 may be passed through the bottom portion 66 of planar element 28. Rivets 60 aid in retaining the shape of the foot 34 so that it does not otherwise spring open. If the foot 34 were to lose its shape, this could impede the movement of foot 34 as it slides through the base 36. It is to be understood that the rivets 60 may take the form of various fasteners or means of fastening, including bolts, rivets, or other means. "Punch" fasteners may also be used in place of the rivets 60. "Punch" fasteners are formed by causing an indentation in the bottom portion 66. The indentations are of sufficient depth to cause the panels of bottom portion 66 to be fastened together.

The clip 14 of the present invention further preferably includes a shelf 62 extending generally perpendicular to the upstanding planar body 28. The shelf 62 may be formed by making an inverted, U-shaped cut in the upstanding planar body 28 and folding the resultant cut-out shelf 62 until it is perpendicular to the upstanding planar body 28. The shelf 62 is located so as to support the panel members 10 during attachment of the panels 10 to the clip 14. The panels 10 may be rested upon the shelf 62 during construction.

Centering means, such as spaced dimples 50 on the upstanding planar body 28 on either side of the base 36, may be utilized, as desired, to properly center the base 36 with respect to the foot 34 during installation.

While the form of the apparatus herein described constituents a preferred embodiment of the invention, it is to be understood that the present invention is not limited to this precise form and that changes may be made therein without departing from the scope of the invention.

What is claimed is:

1. A clip connector comprising:

a clip having an upstanding planar body, a crown shaped to engage said interlocking panels, and a foot located at the bottom of said planar body and being substantially perpendicular thereto and extending outwardly therefrom to form toe and heel portions, respectively;

a generally U-shaped base shaped to slidably retain said foot and projecting outwardly therefrom, said base having an upwardly-opening mouth to receive said planar body therethrough, a cover overlying said toe and a sole associated with said heel and underlying said foot, and an aperture extending through said cover and said sole exteriorly of said base;

a washer located between said cover and said sole and axially aligned with said aperture;

whereby a fastener is extended through said aperture and said washer securing said base to a supporting member, said fastener forcing said cover and sole into restrained but slidable engagement with said foot, said washer preventing overtightening of said fastener to thereby avoid clamping of said cover and sole on said foot such that said panels are movable with respect to said supporting members as said foot moves with respect to said base.

2. The clip connector of claim 1 wherein said washer comprises an upper section and a lower section, said upper section being located between said sole and said cover, said lower section abutting said sole.

3. The clip connector of claim 2 wherein said washer lower section has an outwardly flared bore whereby said flared bore collects shavings generated when said fastener is extended through said aperture and into said supporting member.

4. The clip connector of claim 1 wherein said upstanding planar body includes a shelf extending generally perpendicular to said planar body, said shelf being located so as to temporarily support a panel during connection of said panels to said connector.

5. The clip connector of claim 1 wherein said clip further comprises a bottom portion adjacent to said foot formed by folding said planar body upon itself; and a fastener extending through said bottom portion to thereby retain the shape of said foot.

6. The clip connector of claim 1 wherein said crown upper surface consists of a generally flat surface and a plurality of evenly longitudinally spaced holes to allow sealant to flow therethrough.

7. The clip connector of claim 6 wherein said crown includes a plurality of raised dimples shaped to form a void to receive sealant.

8. A method for anchoring rigid interlocking panels to supporting members, the method comprising:

selecting a clip having an upstanding planar body, a crown which mates with interlocked panels, and a foot formed from the bottom of said planar body and being substantially perpendicular thereto and extending outwardly therefrom to form toe and heel portions, respectively;

slidably mounting said foot to a generally U-shaped base projecting outwardly therefrom, said base having an upwardly-opening mouth to receive said planar body, a cover overlying said toe and a sole associated with said heel and underlying said foot, and an aperture extending through said cover and said sole exteriorly of said base;

placing a washer between said cover and said sole and axially aligned with said aperture;

whereby a fastener is extended through said aperture and said washer securing said base to a supporting member, said fastener forcing said cover and sole into restrained but slidable engagement with said foot, said washer preventing overtightening of said fastener to thereby avoid clamping of said cover and sole on said foot such that said panels are movable with respect to said supporting members as said foot moves with respect to said base.

9. The method of claim 8 wherein said washer comprises an upper section and a lower section, said upper section being located between said sole and said cover, said lower section abutting said sole.

10. The method of claim 9 wherein said washer lower section has an outwardly flared bore whereby said flared bore collects shavings generated when said fastener is extended through said aperture and into said supporting member.

11. The method of claim 8 wherein said upstanding planar body includes a shelf extending generally perpendicular to said planar body, said shelf being located to temporarily support a panel during connection of said panels to said connector.

12. The method of claim 8 wherein said clip further comprises a bottom portion adjacent to said foot formed by folding said planar body upon itself, said method further comprising the step of passing a fastener through said bottom portion to thereby retain the shape of said foot.

13. The method of claim 8 wherein said crown upper surface consists of a generally flat surface and a plurality of evenly longitudinally spaced holes to allow sealant to flow therethrough.

* * * * *